US005265664A

United States Patent [19]

Turner et al.

[11] Patent Number: 5,265,664

[45] Date of Patent: Nov. 30, 1993

[54] FIXTURE FOR FORMING EVAPORATIVE PATTERN (EPC) PROCESS PATTERNS

[75] Inventors: Paul C. Turner; Ronald R. Jordan, both of Albany; Jeffrey S. Hansen, Corvallis, all of Oreg.

[73] Assignee: The United States of America as represented by the Secretary of the Interior, Washington, D.C.

[21] Appl. No.: 813,709

[22] Filed: Dec. 27, 1991

[51] Int. Cl.[5] ..... B22C 9/04

[52] U.S. Cl. ..... 164/34; 164/35

[58] Field of Search ..... 164/34, 35, 36

[56] References Cited

FOREIGN PATENT DOCUMENTS 1-278936 11/1989 Japan ..... 164/34

*Primary Examiner*—Kuang Y. Lin

*Attorney, Agent, or Firm*—E. Philip Koltos

[57] ABSTRACT

A method of casting metal using evaporative pattern casting process patterns in combination with a fixture for creating and maintaining a desired configuration in flexible patterns. A pattern is constructed and gently bent to the curvature of a suitable fixture. String or thin wire, which burns off during casting, is used to tie the pattern to the fixture. The fixture with pattern is dipped in a commercially available refractory wash to prevent metal adherence and sticking to the fixture. When the refractory wash is dry, the fixture and pattern are placed in a flask, and sand is added and compacted by vibration. The pattern remains in position, restrained by the fixture. Metal that is poured directly into the pattern replaces the pattern exactly but does not contact or weld to the fixture due to the protective refractory layer. When solid, the casting is easily separated from the fixture. The fixture can be cleaned for reuse in conventional casting cleaning equipment.

13 Claims, 5 Drawing Sheets

FIXTURE FOR FORMING EVAPORATIVE PATTERN (EPC) PROCESS PATTERNS

TECHNICAL FIELD

This invention relates to sand casting of iron, aluminum and copper-base metals, and more particularly to a suboperation and variation of the evaporative pattern casting (EPC) process.

BACKGROUND ART

The EPC process entails the use of inexpensive and expendable patterns that are made from a low melting point, low density, highly vaporizable material such as expanded polystyrene. The pattern is coated with a refractory wash that is typically comprised of fine silica in an organic vehicle/binder. The wash is dried, and the coated pattern is placed in a flask to which unbonded sand is added. The sand is compacted and densified around the pattern by means of fluidization and vibration. Molten metal is poured directly into the pattern, which immediately vaporizes momentarily leaving a cavity. The metal takes the place of the pattern in its exact configuration. Gases from the pattern exit through the sand.

Expanded polystyrene is weak and semi-flexible. In small cross-sections, expanded polystyrene patterns can easily be bent or broken by hand. Extreme care is required in all phases of the EPC process to avoid distortion and damage to patterns because any disfigurement ultimately will be reproduced in the casting. The molding operation is particularly critical, because during vibration and compaction of the pattern and sand in a flask, the sand moves, often with considerable force, in currents which are unknown. The pattern is forced to move with the same and is frequently bent or distorted, and sometimes broken, in the molding operation. The final shape of the pattern in the mold after compaction determines the ultimate shape of the casting. Distortion may not occur, or may be unnoticeable, with thick, stocky parts. However, if a part has a large surface and thin cross-section, considerable pattern movement may take place.

Alternatively, a structure or part may be designed with a regular curvature. An example is a tank constructed from plate sections. When such plates are made by casting for specialty applications, the curvature is likely cast as a feature of the plate rather than added by a subsequent forming operation. With EPC, plate section patterns are made flat and bent to the radius of the tank. Pattern distortion due to movement could result in unusable castings.

Those concerned with these and other problems recognize the need for an improved method of casting metal using EPC process patterns.

DISCLOSURE OF THE INVENTION

The present invention provides a method of casting metal using evaporative pattern casting process patterns in combination with a fixture for creating and maintaining a desired configuration in flexible patterns. A pattern is constructed and gently bent to the curvature of a suitable fixture. String or thin wire, which burns off during casting, is used to tie the pattern to the fixture. The fixture with pattern is dipped in a commercially available refractory wash to prevent metal adherence and sticking to the fixture. Preferably, the refractory wash is comprised of fine silica in an organic vehicle and binder. When the refractory wash is dry, the fixture and pattern are placed in a flask, and sand is added and compacted by vibration. The pattern remains in position, restrained by the fixture. Metal that is poured directly into the pattern replaces the pattern exactly but does not contact nor weld to the fixture due to the protective refractory layer. When solid, the casting is easily separated from the fixture. The fixture can be cleaned for reuse in conventional casting cleaning equipment.

An object of the present invention is the provision of an improved method of casting metal using EPC process patterns.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

The following examples are illustrative of the best mode for carrying out the invention. They are obviously not to be construed as limitative of the invention since various other embodiments can readily be evolved in view of the teachings provided herein.

EXAMPLE 1

As part of a cooperative project with the United States Tank and Automotive Command (TACOM) the Albany Research Center (ALRC), the Bureau of Mines was required to make several EPC castings from steel that measured about 15 inches high, 0.625 inches thick, and from two to four feet long. The parts also contained a regular array of oblong slots over most of the surface. Several of the parts were curved along the long axis.

While it is conceivably possible to mold the patterns with the curvature as part of the mold, the tooling for such a mold would be prohibitively expensive. Additionally, the curvature could not be assured if normal EPC methods including loose sand molding were followed. A device for restraining the patterns to prevent unwanted distortion while assuring the necessary curvatures was needed. Fixtures were built to accomplish both objectives.

Figure 1:
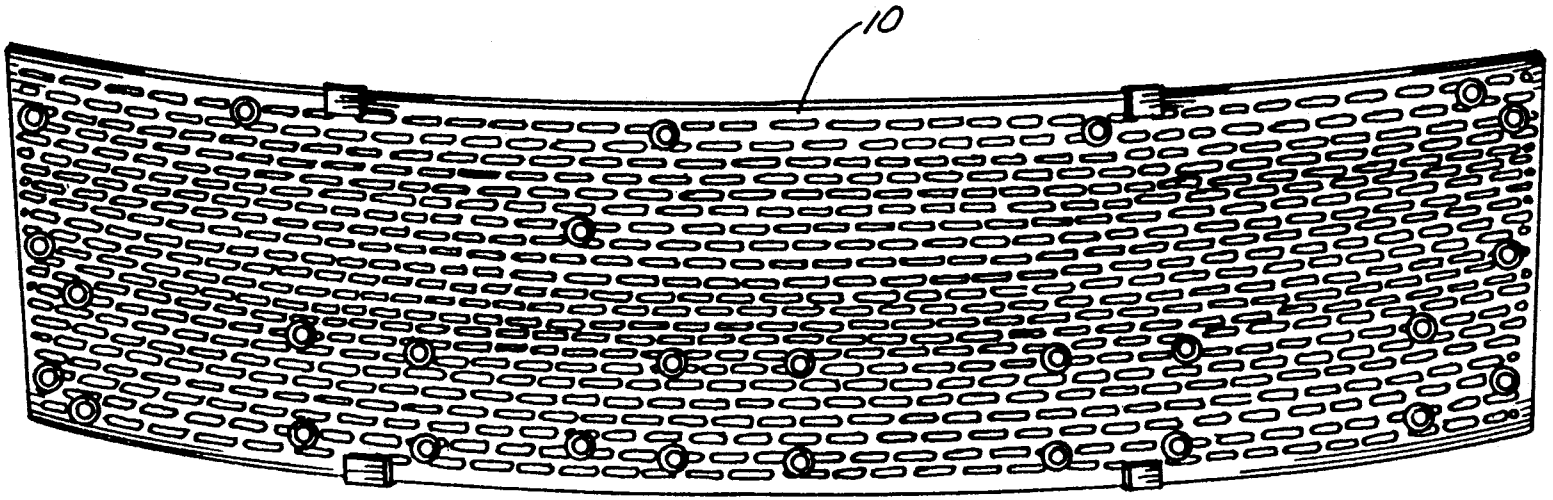
FIG. 1 is a perspective view of a casting of an armor plate.

A specific embodiment of the invention is included in the casting operation of a curved 0.625 by 15 by 50 inch armor plate section shown in FIG. 1. It will be noted in FIG. 1 that the armor plate (10) contains slotted holes over much of its surface and that the slotted holes are not perpendicular to the surface. Furthermore, it can be surmised that it would be extremely difficult to make the plate (10) with the slotted holes by any conventional fabrication or casting process with the exception of EPC or investment casting. The EPC process was chosen for this embodiment because it was the least expensive alternative that was capable of producing acceptable surface finishes. The superior surface finish and dimensional accuracy features of the considerably more expensive investment casting process were not necessary.

The EPC process has been in practice with several variations for 30 years and is a reliable method for making mass produced cast parts, especially with aluminum. The process is generally used with loose unbonded sands although large cast iron structures such as dies also have been made with the EPC process using bonded sands.

Heretofore, a need has not arisen for devices to maintain the rigidity of patterns and to assure the dimensional accuracy of castings made from the patterns. This lack of need has been due to the nature of the parts considered for the EPC process, i.e., most have been small and compact or large and bulky. The invention embodiment was relatively thin walled. Patterns of the armor plate were easily flexed and distorted. Without external support, the patterns deformed due to their lack of rigidity and as a result of the forces of sand against them during the molding step of the EPC process.

Figure 2:
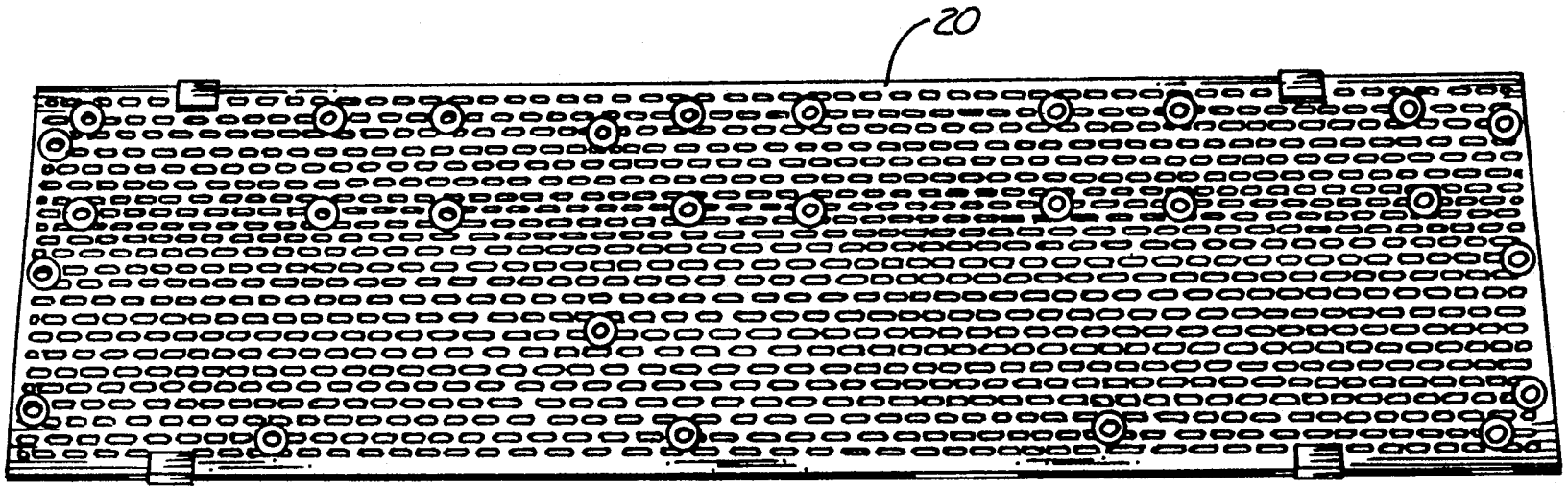
FIG. 2 is a perspective view of a pattern made from expanded polystyrene.

FIG. 2 shows the armor plate pattern (20) as fabricated and assembled from stock forms. Patterns measuring 1.25 by 15 by 24 inches with the slotted design feature were produced in a single mold. The solid edges and mounting holes were made from a solid block of expanded polystyrene. As a consequence of the invention, the stock forms also were used to make a variety of other patterns, thus eliminating the need and expense for separate molds to make each individual pattern.

Figure 3:
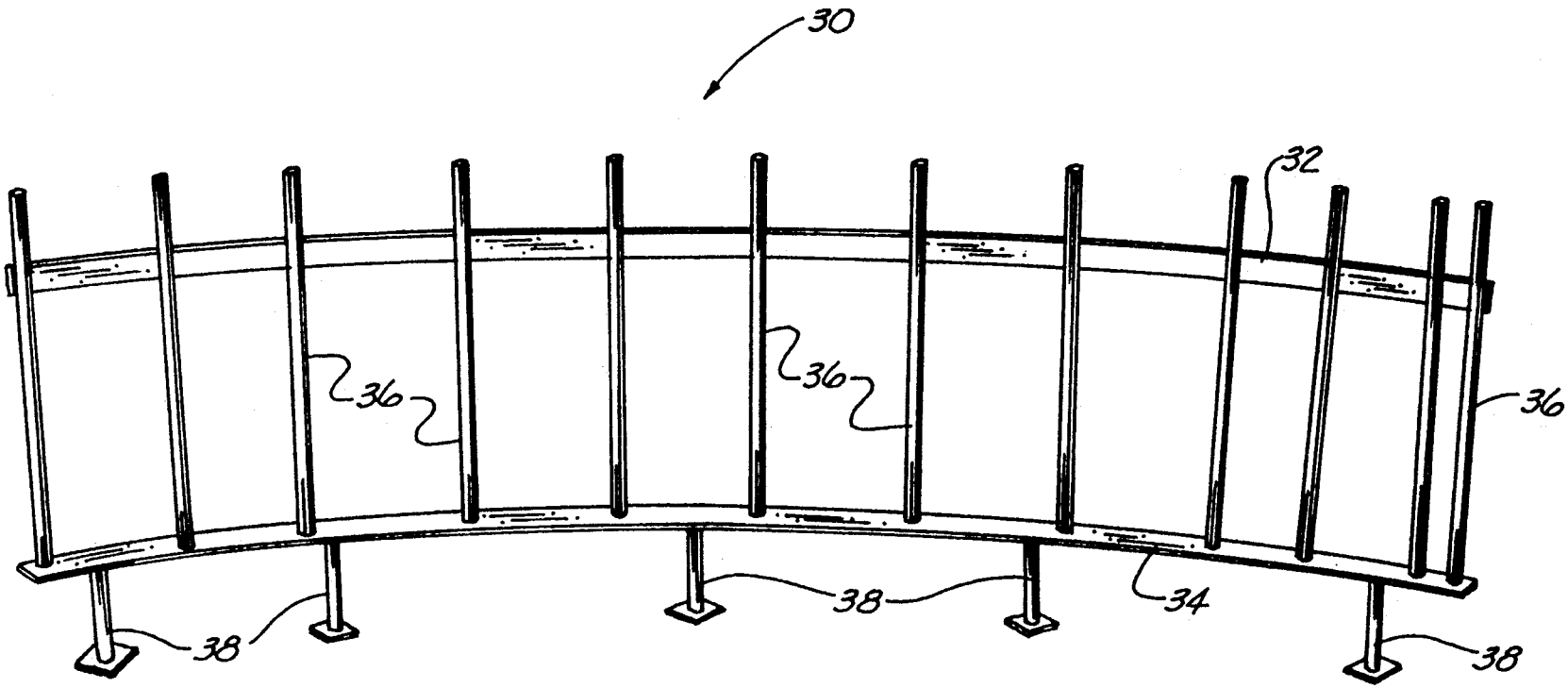
FIG. 3 is a perspective view of a fixture to form the casting curvature and provide rigidity to the pattern.

FIG. 3 shows the fixture (30) for creating the contour of the armor plate (10). The radius of the contour was established by upper and lower borders (32, 34) that were fabricated from ⅛ inch plate steel. The borders were spaced apart by ½ inch diameter bars (36) that served to define the radius at interior portions of the pattern and also to provide attachment points for tying the pattern to the fixture with string. Legs (38) were added to the bottom of the fixture to support the pattern/fixture assembly in the flask at an optimum level above the flask bottom.

The configuration of the fixture (30) may be as simple as a flat surface. The fixtures are typically constructed with steel bars of sufficient rigidity to resist bending and distortion while permitting the free flow of sand during mold compaction. The steel bars (36) also allow patterns (20) to be tied to the bars, which appears to be the simplest method of pattern attachment. The fixtures are light weight and can be handled easily in all operations. The use of steel and refractory coatings guarantees that the fixtures will remain rigid and that they can be used many times without maintenance.

Figure 4:
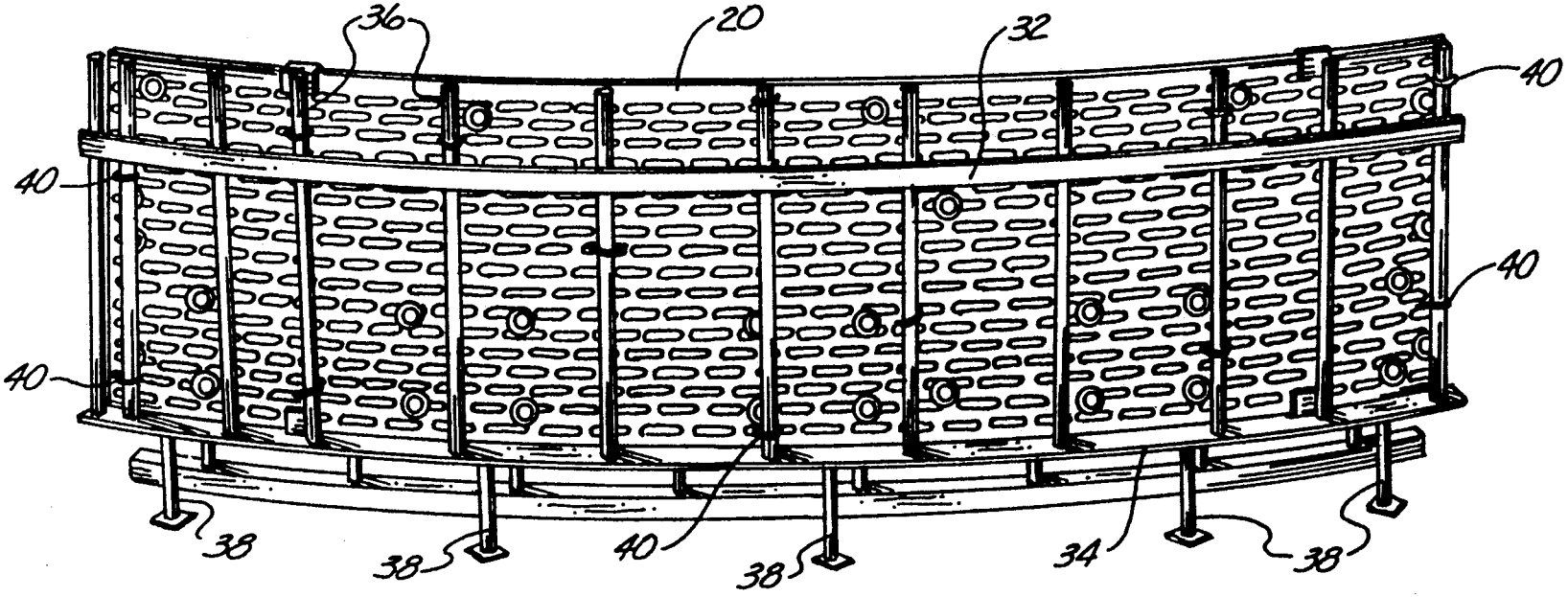
FIG. 4 is a perspective view of a pattern formed and tied to a fixture.

FIG. 4 shows a pattern (20) formed to the contour of the fixture (30) and tied in place with string (40). A sprue and gates were added at this time, and the entire assembly was dipped in a silica refractory wash and dried. Without the fixture (30), a refractory-coated pattern was prone to flexure, cracking and spalling of the refractory coating. The fixture eliminated these difficulties and permitted a modicum of rough handling that could be expected in mass production.

Figure 5:
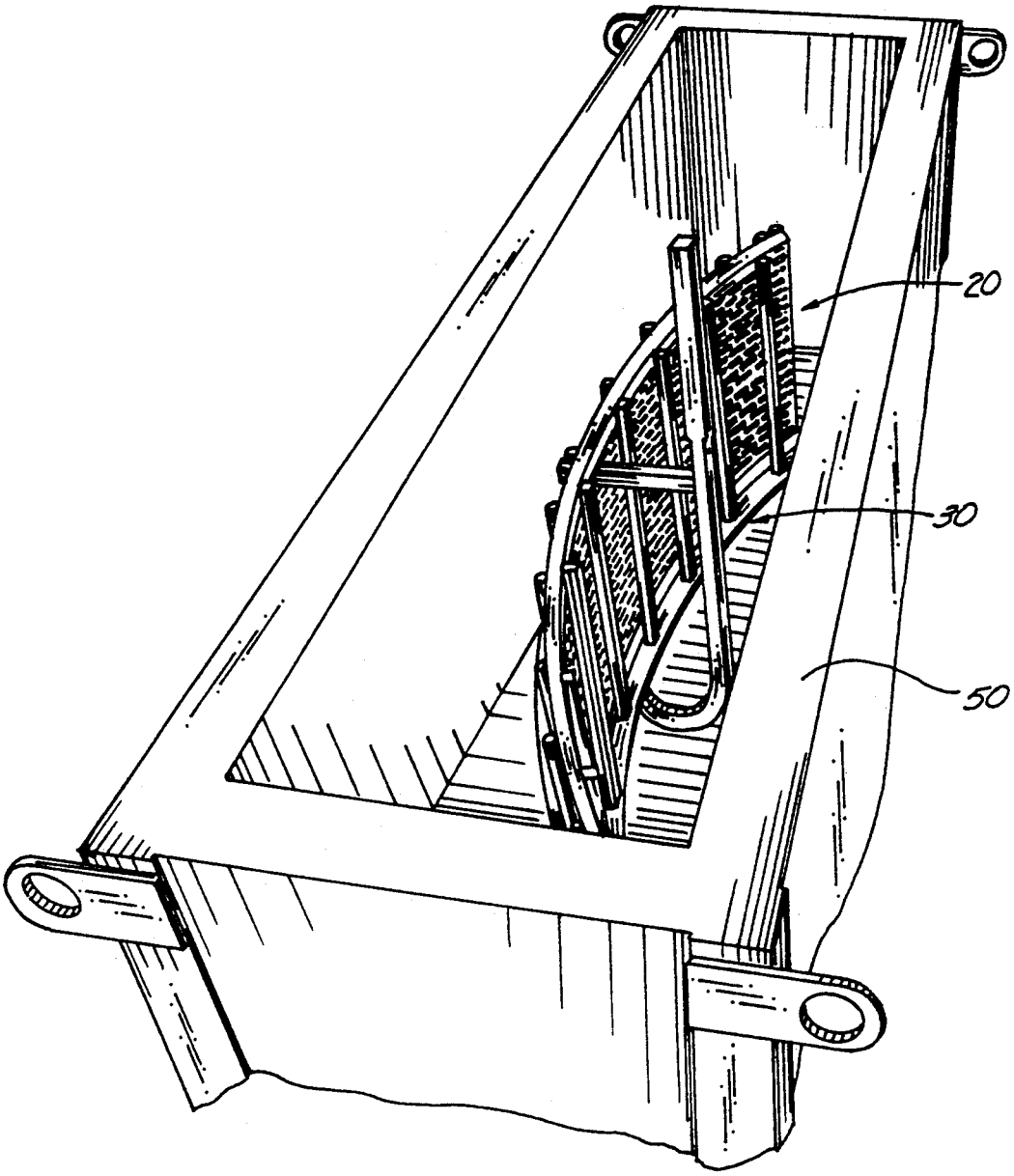
FIG. 5 is a perspective view of a refractory coated fixture/pattern assembly in a flask prior to sand addition.

The fixture/pattern assembly was placed in a suitable casting flask (50) as shown in FIG. 5, and loose sand was added. The sand was fluidized and compacted by vibration with no apparent movement of the pattern from the confines of the fixture (30). Without the fixture (30), pattern movement was unpredictable, and the resulting castings were always warped and required straightening and forming, a difficult operation at best.

Pouring and casting removal and cleaning were straight-forward EPC operations. No difficulty was encountered in separating the casting from the fixture. Both the casting and the fixture were cleaned in the same cleaning operation. The fixture is useable many times without further conditioning or maintenance. As the finished casting in FIG. 1 shows, the contour of the casting follows the required radius evenly.

A unique feature of the invention is the use of a fixture (30) that provides rigidity to a polystyrene pattern (20) during handling and molding in the EPC process. Without the fixture (30), an unsupported, thin-walled expanded polystyrene pattern (20) is readily deflected, perhaps even by its own weight but certainly by the movement of sand during sand vibration and compaction in the molding stage of the EPC process. The fixture (30) prevents pattern deflection until the part is cast.

A second unique feature of the invention is the use of a fixture (30) to establish flatness, dimensional accuracy or a specific contour on a thin-walled expanded polystyrene pattern (20). The contour is maintained by the fixture (30) throughout the molding and casting process, and critical dimensions are preserved. The fixture (30) may be used over and over.

While only certain preferred embodiments of this invention have been shown and described by way of illustration, many modifications will occur to those skilled in the art and it is, therefore, desired that it be understood that it is intended herein to cover all such modifications that fall within the true spirit and scope of this invention.

We claim:

1. A method for casting a metal piece using evaporative pattern casting process patterns, said method comprising the steps of:
   - constructing a pattern from a flexible highly vaporizable material;
   - constructing a fixture from a rigid material;
   - positioning the pattern in contact with the fixture;
   - conforming a substantial portion of said pattern to match a substantial portion of the contour of said fixture;
   - placing the fixture and attached pattern in a flask and adding and compacting sand around the pattern; and
   - pouring molten metal into the pattern to form a cast metal piece, said cast metal piece having substantially the same contour as said fixture.

2. The method of claim 1 wherein the pattern material is expanded polystyrene.

3. The method of claim 1 wherein the fixture material is steel.

4. The method of claim 1 wherein the pattern is secured to the fixture by fine wire.

5. The method of claim 1 wherein the pattern is secured to the fixture by string.

6. The method of claim 1 wherein the refractory wash is comprised of fine silica in an organic vehicle and binder.

7. The method of claim 1 wherein the sand added to the flask is unbonded.

8. The method of claim 1 wherein the molten metal is iron.

9. The method of claim 1 wherein the molten metal is aluminum.

10. The method of claim 1 wherein the molten metal is copper-base.

11. The method of claim 3 wherein the fixture includes a plurality of spaced bars attached to and interconnecting an upper and lower border.

12. The method of claim 11 wherein the fixture further includes legs attached to and extending downwardly from the lower border.

13. The method of claim 1 wherein said step of conforming comprises bending said pattern to match the contour of said fixture.

* * * * *